US006799922B2

(12) United States Patent
Smith

(10) Patent No.: US 6,799,922 B2
(45) Date of Patent: Oct. 5, 2004

(54) ASPHALT DELIVERY AND COMPACTION SYSTEM

(75) Inventor: John Paul Smith, Carmel, CA (US)

(73) Assignee: Advanced Paving Technologies, Inc., Monterey, CA (US)

( * ) Notice: Subject to any disclaimer, the term of this patent is extended or adjusted under 35 U.S.C. 154(b) by 0 days.

(21) Appl. No.: 10/367,150

(22) Filed: Feb. 13, 2003

(65) Prior Publication Data

US 2004/0161299 A1 Aug. 19, 2004

(51) Int. Cl.[7] ..... E01C 7/32
(52) U.S. Cl. ..... 404/75
(58) Field of Search ..... 404/75, 89, 101, 404/108, 118, 115

(56) References Cited

U.S. PATENT DOCUMENTS 4,854,769 A * 8/1989 Fukukawa et al. ..... 404/72
5,405,214 A * 4/1995 Campbell ..... 404/80
5,452,966 A * 9/1995 Swisher, Jr. ..... 404/72
5,549,412 A * 8/1996 Malone ..... 404/84.1
6,227,761 B1 * 5/2001 Kieranen et al. ..... 404/84.5

* cited by examiner

*Primary Examiner*—Robert E. Pezzuto
*Assistant Examiner*—Raymond Addie
(74) *Attorney, Agent, or Firm*—The Kline Law Firm

(57) ABSTRACT

A system and device for obtaining a topographical profile of a road bed, and then delivering an asphalt mat that varies in thickness according to that profile. The system enables variance in the mat thickness across the width of the mat as well as in the normal longitudinal direction. The process is begun by obtaining a three-dimensional profile of the surface to be paved. A scanning means is moved over the road surface to obtain a profile of the entire length and width of the surface to be paved to obtain a detailed topographical profile. In a second phase of the operation, the scanning means is utilized in combination with an asphalt delivery mechanism. The scanning means tracks the exact position of the asphalt delivery mechanism, correlates that to the scanned profile, and thereby controls the operation of the asphalt delivery mechanism. The asphalt delivery mechanism delivers a mat of asphalt of a varying thickness determined by the topographical profile in conjunction with a compression factor for the asphalt material. The mat thickness, both lengthwise and along a width, is controlled by a variable screed.

6 Claims, 7 Drawing Sheets

ASPHALT DELIVERY AND COMPACTION SYSTEM

BACKGROUND OF THE INVENTION

1. Field of the Invention

The present invention relates generally to roadway construction equipment, and more particularly is a multi-dimensional asphalt delivery and compaction system that delivers asphalt to a roadway based on a topographical scan of the road bed.

2. Description of the Prior Art

Various types of equipment are used to provide hard surfaces for streets, highways, parking lots, etc. Included among the broad array of available equipment is an asphalt paver which uses a screed to level a layer, or mat, of asphalt material on an underlying subgrade. Ideally, asphalt paving produces a relatively flat surface in order to provide a smooth ride for vehicles to pass over. Thus, other than for following the gradual curvature of the underlying terrain and for intentional "crowning", (to encouraging drainage of surface water), the mat placed by the asphalt paver offers an essentially planar surface. This result is optimal if the underlying subgrade has a corresponding planar surface.

After the mat is placed by the paver, the mat is compacted with a heavy roller, which compresses the asphalt maternal to a factor of the thickness of the mat as laid by the paver. If the asphalt material has a uniform density and thickness, which is greater than a certain minimum thickness relative to the size of the aggregate contained in the asphalt material, then the actual thickness of the asphalt mat after compaction depends on the thickness of the asphalt material prior to compaction by the roller. The ratio between (a) the difference in thickness of the mat before and after compaction with the roller, and (b) the thickness of the asphalt mat as placed, is commonly referred to as the "compaction factor".

If the underlying subgrade and the asphalt material mat are both planar, and if the asphalt material has a uniform density, then the rolled surface will also be planar, as desired. In an actual situation, however, the surface of the underlying subgrade generally has depressions and elevations that cause the surface of the compacted mat to vary substantially from a planar profile. Thus, the asphalt material mat, even though having a substantially planar surface as laid by the asphalt paver, is thicker in some places than in others. As a result, the asphalt, after compaction, no longer exhibits the substantially planar surface but, instead, has depressions and elevations similar to, but less pronounced than, those of the subgrade surface. This uneven result is sometimes referred to as "differential compaction".

For example, assume that the desired thickness of asphalt material nominally laid by a paver prior to compaction is six inches. Assume also that the subgrade has a local depression that is two inches deep and a ridge or local elevation that is two inches high. Thus, the thickness of the asphalt material laid by the paver would be eight inches deep over the local depression and only four inches deep over the local elevation. Assume further that the roller compacts the asphalt material to seventy-five percent of its original thickness as laid by the paver, or a reduction in thickness of twenty-five percent. After compaction by the roller, the thickness of the asphalt material over the substantially planar surface of the subgrade would be four and one-half inches.

Similarly, the thickness of the compacted asphalt material over the depression and the localized elevation would be six inches and three inches, respectively. In other words, the surface of the asphalt mat that was substantially planar, as provided by the paver prior to compaction by a roller, now has a surface over the depression that lies one-half inch below the surface of the nominal mat. Further, the surface of the compacted asphalt mat over the local elevation lies one-half inch above the surface of the compacted nominal mat and one-inch above the surface of the compacted mat above the depression. Such a situation obviously does not provide a smooth ride for a vehicle passing over the surface. Ideally less material should be placed over the localized elevation and more asphalt material should be placed over the depression in order to overcome this effect.

The underlying problem with current art pavers is their inability to compensate accurately and adequately to changes in elevation of the subgrade surface. To a large degree this problem is compounded by the fact that modern screeds are only capable of delivering an asphalt mat that exhibits a planar top surface. This method of delivering asphalt is incapable of providing adequate material to overcome the effects of "differential compaction". Modern screeds do allow for a certain amount of adjustment vertically, which can be manipulated to provide for a degree of slope and grade along the length and width of the asphalt mat being laid. This however, does not provide adequately for localized variations in the subsurface, such as elevations and depressions in the subgrade. Current art pavers generally use an auger working in conjunction with the screed to provide more or less material to a localized area to compensate for the differences in elevation. This does not provide the degree of compensation necessary to provide a completely smooth driving surface once the asphalt mat is compacted.

Modern pavers can only control the delivery of asphalt along three planer surfaces producing an asphalt mat shaped to the subgrade surface and exhibiting a smooth planar surface. Once this mat is compacted further by a heavy roller it will once again resemble the subgrade only to a lesser degree. What is needed is a method of paving that includes the following steps: 1. Obtaining a topographical profile of the surface to be paved. 2. Processing this information to establish the profile of the surface as it is and the profile of the desired finished surface. 3. Computing the distance between these two surfaces to establish the amount of asphalt with a known compaction factor that will be needed to result in the desired finished surface. 4. Using this information and factoring in the displacement of asphalt material that will take place during the compaction phase to design the profile of the asphalt mat as it should be supplied. 5. A means of manipulating the asphalt mat according to this profile in order to supply exactly the right amount of asphalt material to the subsurface location where it is needed. In reality the mat of asphalt provided for compaction should not be planar as current art pavers provide. Instead it should inversely mimic the characteristics of the subgrade surface to a degree that the shaped mat, once compacted, will attain the smooth surface that is desired.

Accordingly, it is an object of the present invention to provide an asphalt delivery system that supplies an asphalt mat with a thickness that varies according to the subgrade surface variations, thus using "differential compaction" to build a better road.

It is a further object of the present invention to provide a method of supplying an asphalt mat that provides for a superior planar upper surface following compaction.

It is a still further object of the present invention to provide an asphalt delivery mechanism that includes a means to obtain and store a topographical profile of the subgrade to be covered.

SUMMARY OF THE INVENTION

The present invention is a method of obtaining a topographical profile of a road bed, processing that data to generate a road profile for the desired road surface, and then delivering an asphalt mat that varies in thickness according to that profile. The asphalt delivery system enables variance in the mat thickness across the width of the mat as well as in the normal longitudinal direction.

The process is begun by obtaining a three-dimensional profile of the surface to be paved. A scanning means is moved over the road surface to obtain a profile of the entire length and width of the surface to be paved. The scanning means can utilize any of several known means of obtaining a detailed topographical profile, and most often will be radar, sonar, or laser measuring equipment used in conjunction with the Global Positioning System (GPS). The profile data obtained is processed for use in the second phase of the operation.

Data for the profile will be gathered in a manner that will provide data such as elevation, slope, and grade with a resolution scale small enough to produce an accurate representation of the surface to be paved. This data will be used to design a road profile that will control all actions of the paving machine. By figuring the difference between the road profile as it is and the road profile as it is desired to be, and factoring in the correct "compaction factor" we can generate a finished mat profile that will produce the desired road surface. This finished mat profile will utilize the effects of "differential compaction" in a constructive way and deliver more asphalt material to where it is needed and less to where it is not. This profile will be loaded into the onboard computers of the paving machine and will accurately control the movement of the paving machine as well as the operation of the asphalt delivery mechanism.

In the second phase of the operation, the scanning means is utilized in combination with an asphalt delivery mechanism. The scanning means tracks the exact position of the asphalt delivery mechanism, correlates that to the scanned profile, and thereby controls the operation of the asphalt delivery mechanism. The asphalt delivery mechanism delivers a mat of asphalt of a varying thickness determined by the topographical profile in conjunction with a compression factor for the asphalt material. The thickness is varied not only along the length of the mat, but also across the width of the mat.

The first key component of the variable asphalt delivery mechanism is the inner chamber. This is where an overly thick asphalt mat of a consistent density is formed and made available to the second key component, the variable screed. The variable screed includes a plurality of individual plates that together form a screed the width of the asphalt mat. The individual plates are each attached to a double-action single piston end hydraulic cylinder that moves the plates up and down along an axis perpendicular to the width of the main blade of the asphalt delivery machine. As the asphalt mat is introduced to the variable screed the manipulation of groups of individual plates causes the asphalt material to be removed from the preformed mat in amounts determined by the stored mat profile, thus controlling the profile of the asphalt material output by the system.

An advantage of the present invention is that it makes allowances for variations along the width of the roadbed as well as variations along the length.

Another advantage of the present invention is that the variable screed allows different amounts of asphalt to be deposited along the width of the roadbed.

A still further advantage of the present invention is that the resultant mat is very smooth following compaction.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
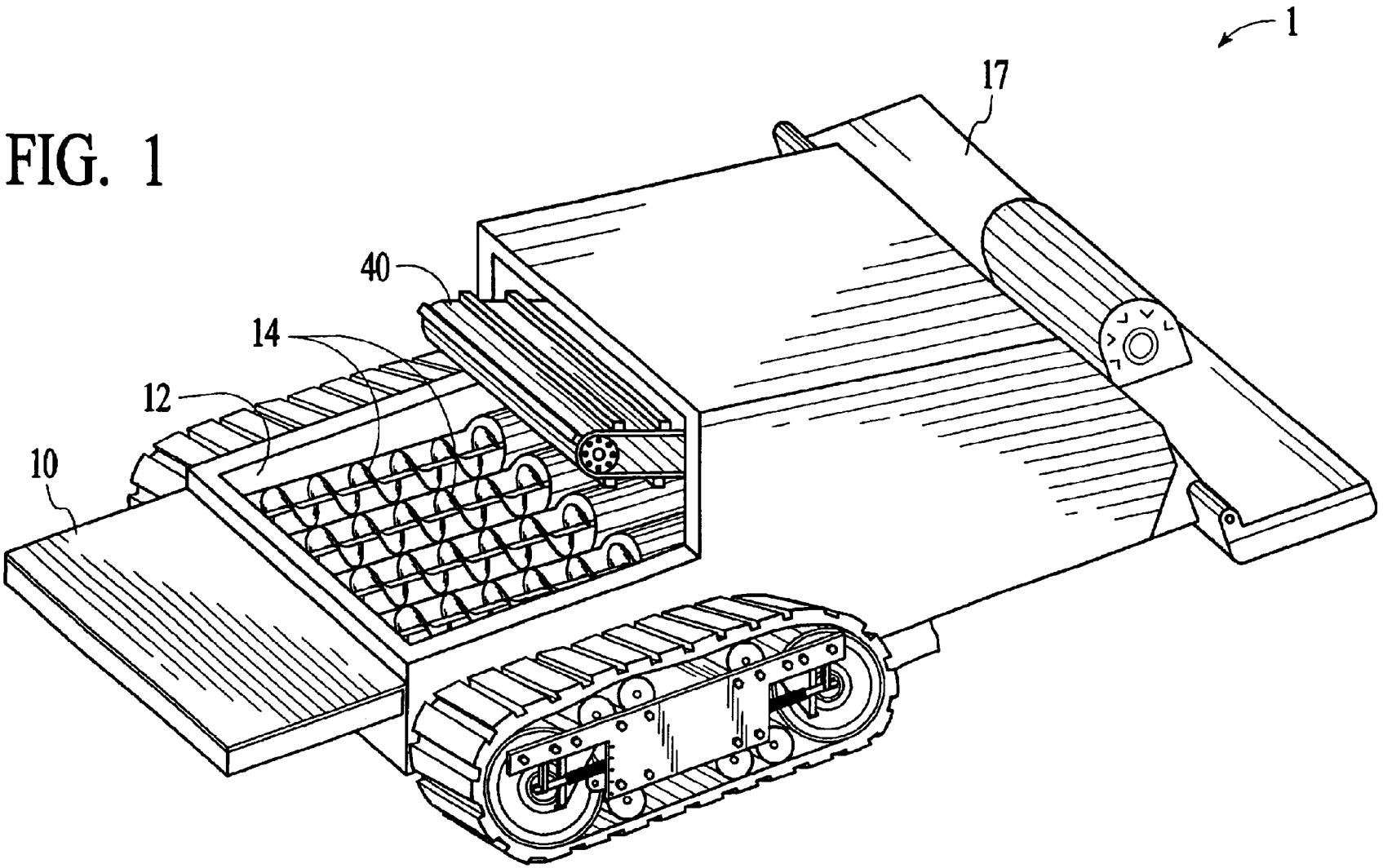
FIG. 1 is a perspective view of the asphalt delivery mechanism of the present invention.
Figure 2:
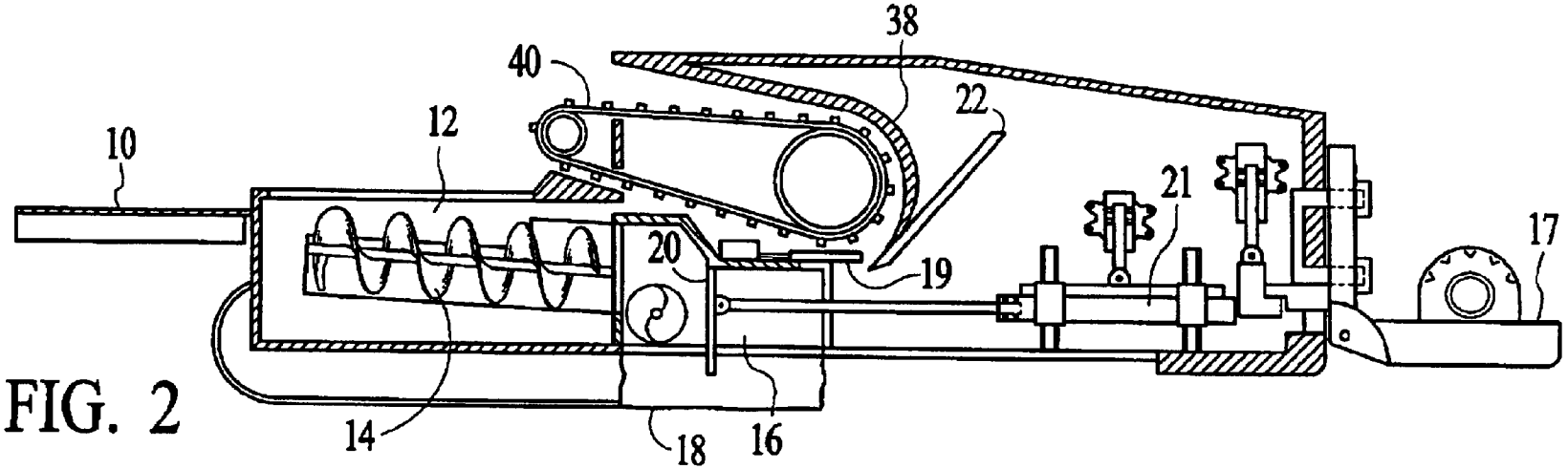
FIG. 2 is a sectional view of the interior of the asphalt delivery mechanism before asphalt is delivered to the inner chamber.
Figure 3:
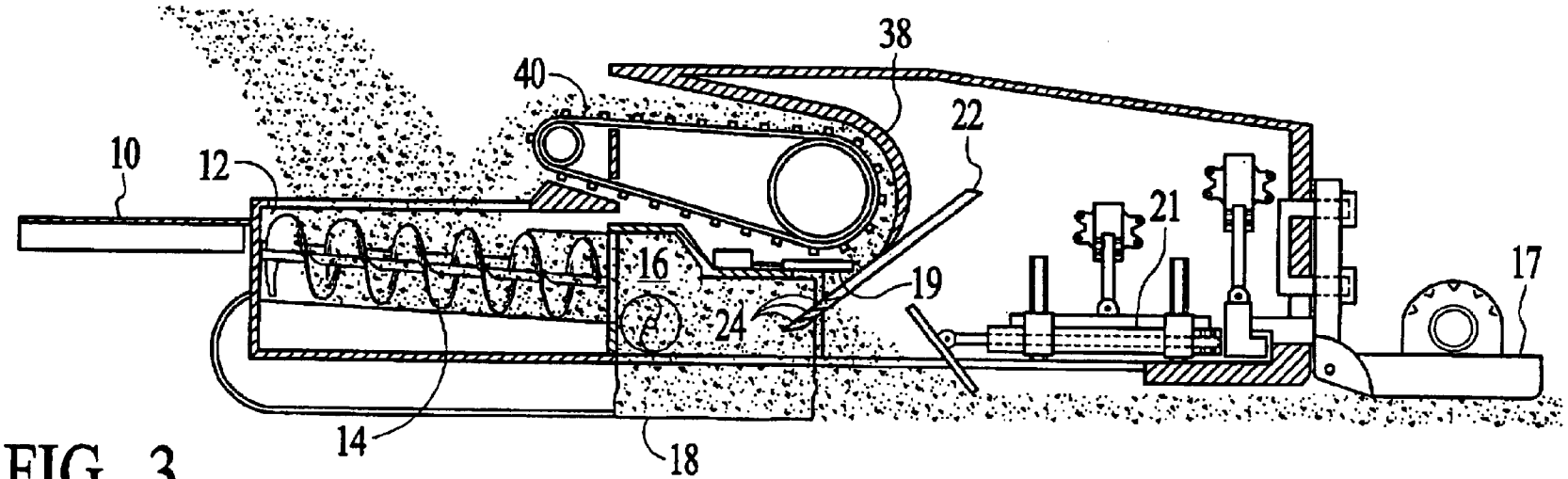
FIG. 3 is a sectional view of the interior of the asphalt delivery mechanism as the asphalt mat is being deposited on the subgrade.
Figure 4:
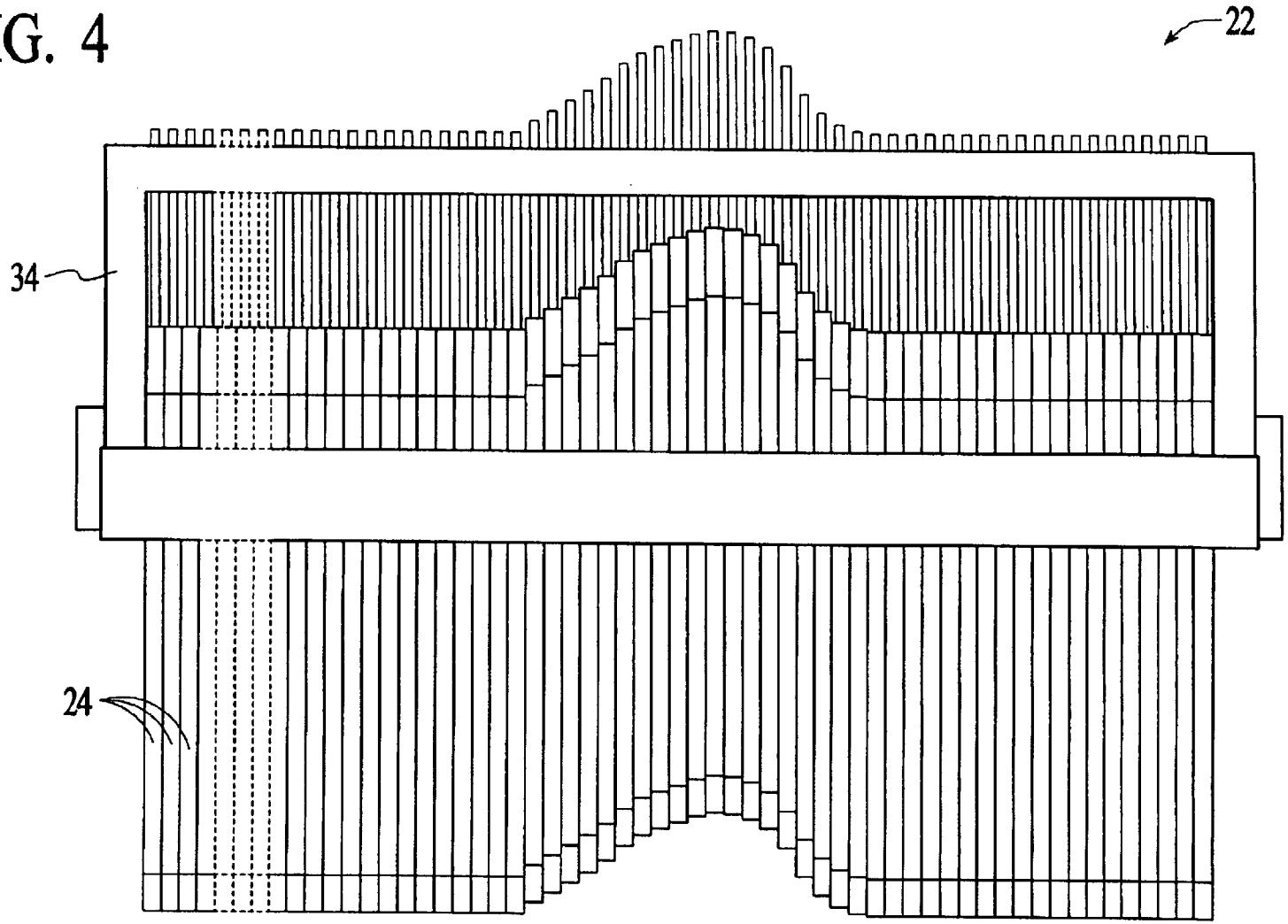
FIG. 4 is a front view of the variable screed.
Figure 5:
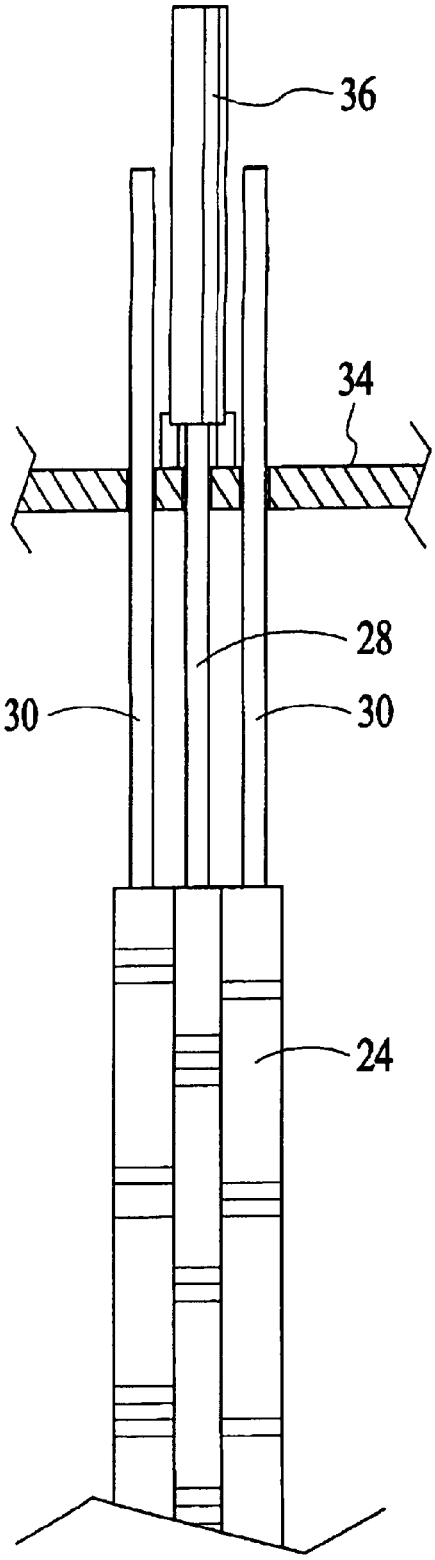
FIG. 5 is a side view showing the top end of an individual screed plate secured in the screed housing.
Figure 6:
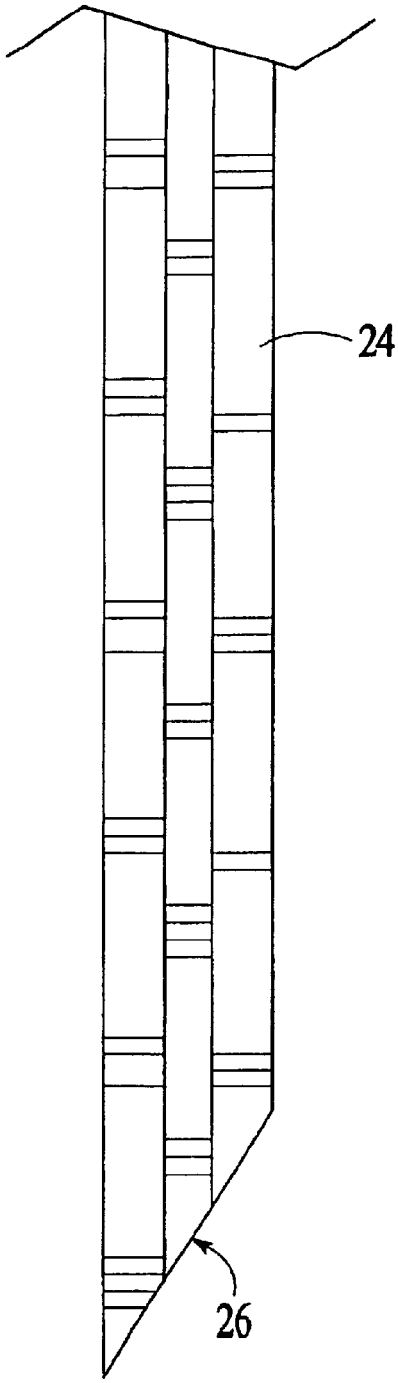
FIG. 6 is a side view showing the bottom end of a screed plate.
Figure 7:
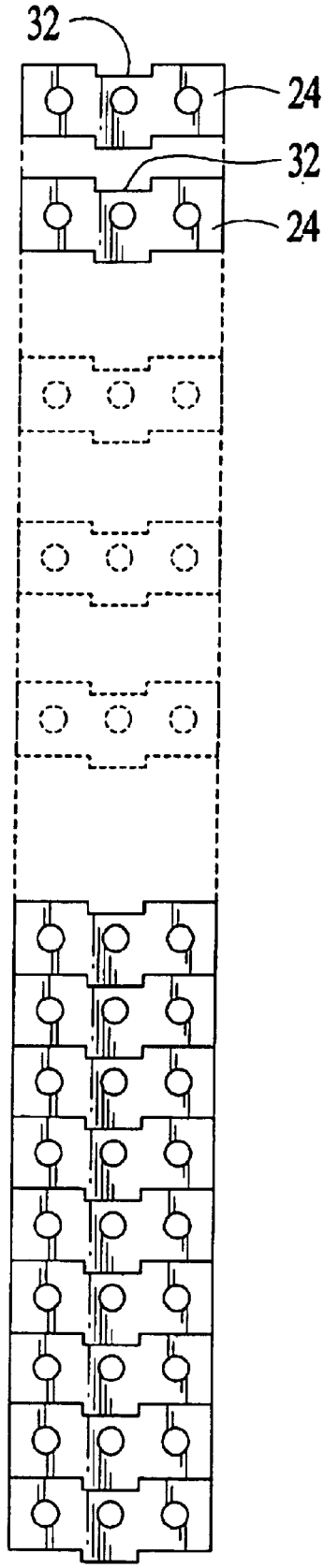
FIG. 7 is a top view showing the screed plated secured in the screed housing.
Figure 8:
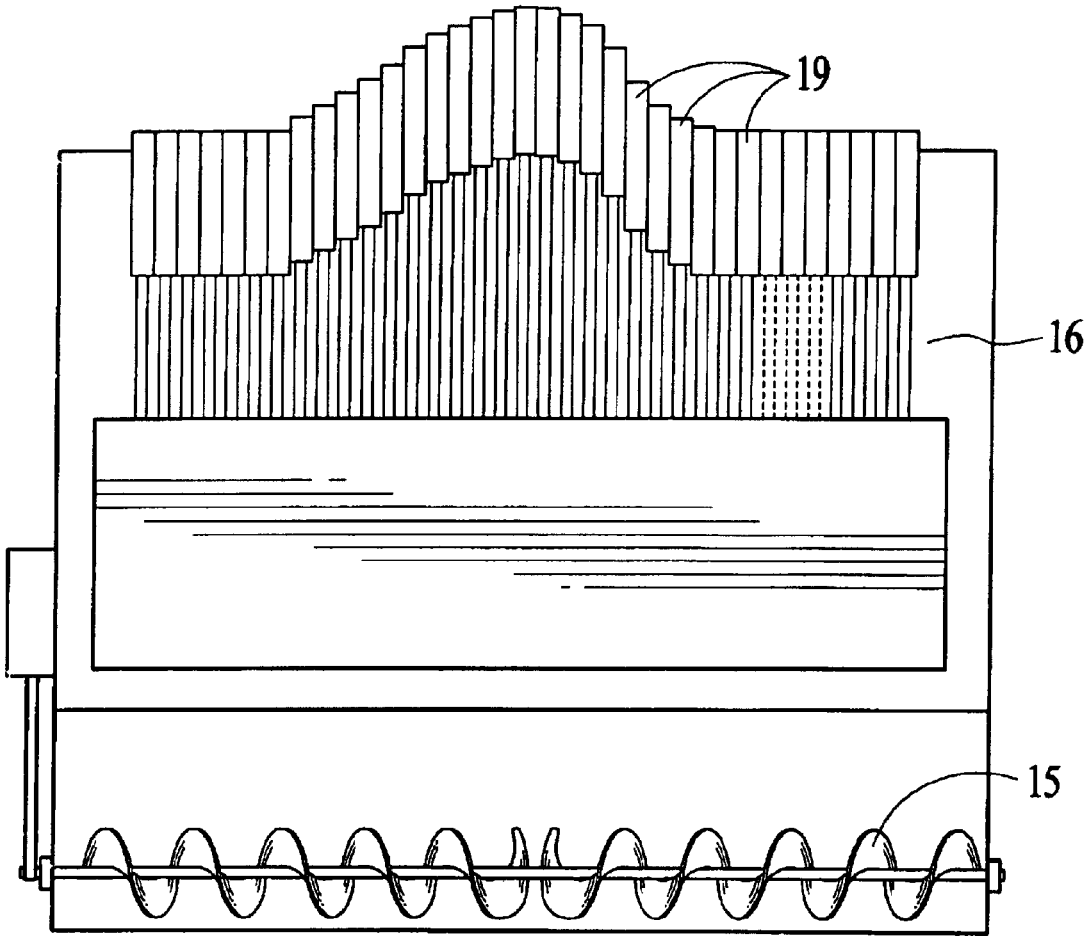
FIG. 8 is a top view of the inner chamber showing the plurality of flat restrictor plates.
Figure 9:
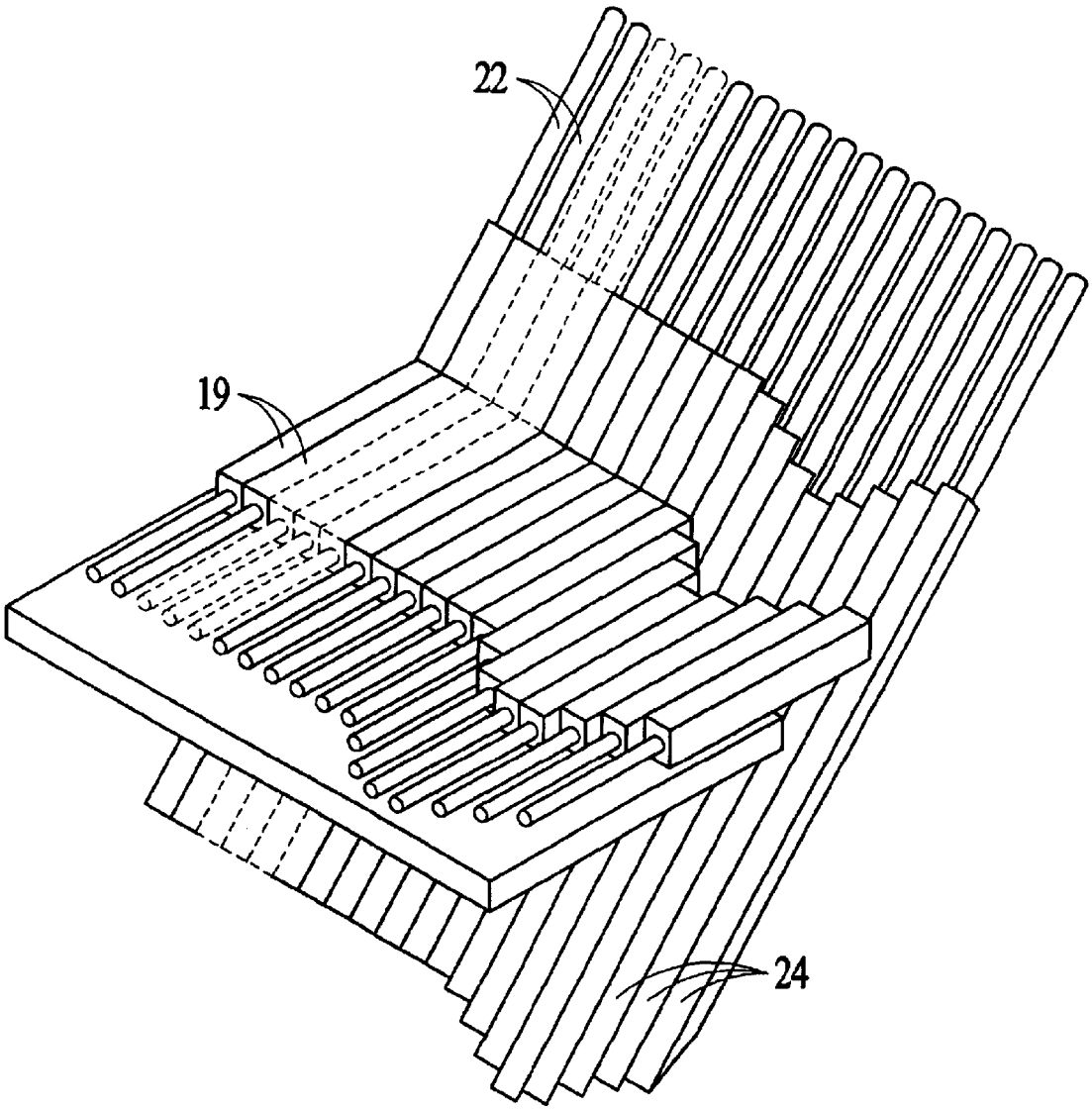
FIG. 9 shows the restrictor plates and the variable screed as positioned in front of the outlet of the dispensing chamber.

Referring first to FIGS. 1–3, the present invention is a system and device, a paving machine 1, that obtains a topographical profile of a road bed, and then delivers an asphalt mat that varies in thickness according to that profile. The system provides variance in the mat thickness across the width of the mat as well as along the length.

The first step in the paving process according to the present invention is to obtain a topographical profile of the surface to be paved. This step is accomplished by a scanning means 10 that is moved over the road surface to obtain a profile of the entire length and width of the surface to be paved. The scanning means 10 can utilize any of several known means of obtaining a detailed topographical profile, and most often will be radar, sonar, or laser measuring equipment used in conjunction with the Global Positioning System (GPS). The profile data generated by the scanning means 10 is stored in an easily accessible data storage means.

Data for the profile will be gathered in a manner that will provide data such as elevation, slope, and grade with a resolution scale small enough to produce an accurate representation of the surface to be paved. This data will be used to control the action of the individual blades comprising the variable screed. By figuring the difference between the road profile as it is and the road profile as it is desired to be, and factoring in the correct "compaction factor" we can utilize the effects of "differential compaction" and generate a finished mat profile that will provide the desired result. This profile will be loaded into the onboard computers of the paving machine and will accurately control the motions of the variable screed to deliver the correct amount of asphalt to where it is needed.

The paving machine 1 includes a hopper 12 that receives hot mix asphalt material. The asphalt is conveyed by a plurality of horizontal feed augers 14 to an inner chamber 16. The augers 14 are driven by at least one variable speed motor so that the amount of asphalt being moved to the inner chamber 16 can be controlled.

The inner chamber 16 has a width equal to a standard asphalt mat. The height of the chamber 16 is two-tiered. The chamber 16 opens into a large area where the asphalt flows down over a transversely mounted spreading auger 15. The spreading auger 15 spreads the asphalt into a second area of the inner chamber 16 that is lower than the chamber opening and has a height equal to the maximum desirable mat thickness. By forcing the asphalt into this second area the asphalt will be compacted a small degree to a desirable density that is consistent across the entire mass. The inner chamber and blades of the augers will be heated to promote the smooth flow of asphalt material within the chamber, as is common practice in modern asphalt paving.

To contain the asphalt as the paving machine moves along the roadway, a skirt 18 is provided around the lower periphery of the rear and sides of the inner chamber 16. The skirt 18 must be heavy enough to keep the asphalt in place, but must be flexible enough to accommodate the surface variations in the subgrade.

Since the blades of the variable screed are positioned at an angle relative to the asphalt mat, as groups of individual blades dig deeper into the asphalt mat the blades also move forward into the main chamber. This will have a resultant effect of paring away a larger amount of asphalt from that particular portion of the mat. As these deeper digging blades remove the asphalt the mat will be distorted along either side causing an inconsistency in the shape and density of the surrounding material.

To maintain the density and uniform shape of the asphalt mat as the blades of the variable screed pare material away from it, a plurality of individual flat restrictor plates 19 with the same width of the individual plates 24 comprising the variable screed 22 are positioned at the top rear edge of the inner chamber 16. The flat restrictor plates 19 are driven so that they slide fore and aft in conjunction with the corresponding blade of the variable screed 22. As a blade of the variable screed 22 moves farther down and into the chamber, the corresponding restrictor plate 19 will be retracted allowing more asphalt material to be removed from the mat at a point farther inside the chamber. Conversely, as a blade 24 of the variable screed 22 moves up and out of the chamber, the corresponding restrictor plate 19 will be extended allowing less asphalt material to be removed from the mat at a point farther out of the chamber. By operating the variable screed 22 and restrictor plates 19 in this manner when a group of blades dig deeper in one section the shape and density of the asphalt mat will be maintained on either side of this section until the blades that are positioned shallower and thus farther out of the chamber pare away the asphalt from their portion of the mat.

As asphalt is delivered to the inner chamber 16, the spreading auger will fill the secondary chamber to the top forming the top surface of the asphalt mat prior to shaping. At this point the paver 1 begins moving forward providing a large mat of equal density to the blades for shaping. Once the inner chamber 16 has filled, the variable screed 22 will come into contact with the mat. As the paver 1 continues to move forward the blades of the variable screed 22 will come into contact with the asphalt mat.

The variable screed 22 comprises a plurality of individual plates 24 that form a screed equal to the width of the asphalt mat. The individual plates 24 each have an angled lower end 26 to effectively penetrate the asphalt. The upper ends of the individual plates 24 are connected to a piston rod 28 and to a pair of stabilizer rods 30. Each of the plates 24 includes a center offset area 32 so that the individual plates 24 are bound together when they are mounted in the screed frame 34. The stabilizer rods 30 and the center offset areas 32 ensure that the plates 24 remain stably positioned in the screed frame 34.

The individual plates 24 (see FIGS. 4–7) are each attached to a double-action single piston end hydraulic cylinder 36 that moves the corresponding individual plate 24 up and down at an angle relative to the roadbed. The plates 24 thus move to greater and lesser distances away from the surface of the subgrade. Working in conjunction with the restrictor plates 19 at the top end of the inner chamber allows for different sized openings from the inner chamber 16, and thus differing flow rates along the width of the screed 22. It is the variation in exit volume of asphalt material out of the inner chamber 16 across the width of the inner chamber 16 that leads to a resultant asphalt mat with varying thickness along the width of the mat. The motion of each of the individual plates 24 is of course controlled according to the stored topographical profile. Any known controlling means will suffice to operate the hydraulic cylinders 36.

As asphalt is peeled away from the mat by the variable screed 22, the excess asphalt contacts a curved return plate 38 that redirects the asphalt toward a return conveyor 40. The return conveyor 40 receives the asphalt that is removed by the screed 22 from the asphalt mat off of the return plate 38 and redeposits the removed asphalt into the hopper 12. As the paving machine continues to move forward the shaped asphalt mat will come into contact with the retracted plate 20 (operated by plate retraction means 21) that can be set at an angle, and that will provide a smoothing effect to the high points of the shaped mat. A tamper assembly 17 is attached to the rear of the paving machine and has a width wider than the paving machine such that it will protrude out from either side of the paving machine. The tamper assembly 17 will be attached to the rear of the paving machine such that it will be able to move up and down and also will pivot on an axis perpendicular to the width of the tamper so that it will float on the surface of the asphalt mat. The tamper assembly 17 compacts the asphalt mat further in preparation for final compaction with a typical heavy roller.

Operating of the paving machine 1 is as follows: A first pass over the roadway or area to be paved is made, either with the paver 1 or if paving is to be performed over a long stretch of road, a separate scanning apparatus will be utilized. By using a separate scanning apparatus, a long stretch of roadway can be quickly scanned, thus allowing for the correction of areas with large elevation differences to be gradually compensated for by the variable screed over a broad distance. The scanning means 10 obtains and stores the topographical profile of the subject area. All topographical data is processed prior to paving, factoring in the "compaction factor" and manipulating effects of "differential compaction" to plot out the desired road surface. The surface is scanned a second time during the paving process mainly to determine position but may make minor adjustments to the loaded map profile.

The paving procedure is begun by accurately positioning the paving machine 1 at the starting point of the mat profile.

Asphalt in the hopper 12 is fed through the augers 14 to the inner chamber 16. When the inner chamber 16 is filled with asphalt, the frame 34 of the variable screed 22 is angled so that the screed 22 is properly positioned at the mouth of the inner chamber 16.

As the paving machine 1 moves forward, the individual blades 24 of the variable screed 22 will come into contact with the asphalt mat. The blades 24 are positioned at a height determined by to the mat profile. In areas where the subgrade is depressed, the individual blades 24 will be moved further away from the mouth of the inner chamber 16 so that more asphalt is deposited in the mat. Conversely, where less asphalt is needed, the blades 24 are moved closer to the inner chamber 16 so that less asphalt flows out into the mat. The screed 22 is positioned at an angle to the flow path of the asphalt so that the blades 24 of the screed 22 easily penetrate the surface of the asphalt. Asphalt removed by the screed flows up the return plate 38 to the return grooved conveyor 40 to be delivered to the hopper 12. The inner chamber 16 and the individual blades 24 of the screed 22 will be heated to promote the smooth flow of asphalt material within the machine, as is common practice in modern asphalt paving.

The output of the paving machine is a mat of asphalt that is formed to the subgrade and shaped in three dimensions as required to provide a smooth planar surface once the mat is compacted. As the paving machine 1 continues to move forward the shaped asphalt mat will come into contact with the tamper-like sled that will provide a smoothing effect to the higher points of the shaped mat. The tamper type assembly that is attached to the rear of the paving machine has a width wider than the paving machine such that it will protrude out from either side of the paving machine. The tamper assembly will be attached to the rear of the paving machine such that it will be able to move up and down and will also pivot on an axis perpendicular to the width of the tamper so that it will float on the surface of the asphalt mat. The tamper assembly will compact the mat further in preparation for final compaction with a heavy roller.

The above disclosure is not intended as limiting. Those skilled in the art will readily observe that numerous modifications and alterations of the device may be made while retaining the teachings of the invention. Accordingly, the above disclosure should be construed as limited by the restrictions of the appended claims.

I claim:

1. A method of depositing an asphalt mat on a surface to be paved comprising the following steps:

a) making a first pass over said surface to be paved so that a scanning means obtains and stores a topographical profile of said surface to be paved, b) accurately positioning a paving machine at a starting point of said topographical profile of said surface to be paved, c) loading asphalt into a hopper of said paving machine, d) causing asphalt to flow into an asphalt dispensing chamber of said paving machine, e) positioning multiple restrictor plates and a multiple element variable screed in front of an outlet of said dispensing chamber to control a flow rate of said asphalt out of said dispensing chamber, said restrictor plates contacting said asphalt after strike-off by said variable screed to minimize distortion of said asphalt, and f) utilizing said topographical profile of said surface to be paved to vary said flow rate of said asphalt out of said dispensing chamber, thereby depositing an asphalt mat of a thickness that varies along a width of said mat as well as longitudinally along said mat.

2. The method of depositing an asphalt mat as defined in claim 1, wherein:

individual elements of said variable screed are moved relative to a mouth of said dispensing chamber to control said flow rate of said asphalt out of said dispensing chamber.

3. The method of depositing an asphalt mat as defined in claim 2, wherein:

motion of said individual elements of said variable screed is controlled by a plurality of double-action single piston end hydraulic cylinders.

4. The method of depositing an asphalt mat as defined in claim 1, wherein:

said scanning means utilizes a global positioning system.

5. The method of depositing an asphalt mat as defined in claim 1, wherein:

individual elements of said variable screed have a width approximately equivalent to a width of individual elements of said restrictor plates.

6. The method of depositing an asphalt mat as defined in claim 1, wherein:

each of said restrictor plates are driven so that they slide fore and aft in conjunction with a corresponding one of said individual elements of said variable screed, said restrictor plates thereby maintaining a shape and density of material surrounding individual elements of said variable screed that dig deeply into a given portion of said asphalt mat.

* * * * *